US008430086B2

(12) United States Patent
Tippmann, Jr. et al.

(10) Patent No.: US 8,430,086 B2
(45) Date of Patent: Apr. 30, 2013

(54) NON-LETHAL PISTOL

(75) Inventors: Dennis J. Tippmann, Jr., Fort Wayne, IN (US); Jeffrey P. Douglas, Fort Wayne, IN (US); Kyle D. Smith, Fort Wayne, IN (US); Bryce A. Carrico, Fort Wayne, IN (US)

(73) Assignee: Tippmann Sports, LLC, Fort Wayne, IN (US)

( * ) Notice: Subject to any disclaimer, the term of this patent is extended or adjusted under 35 U.S.C. 154(b) by 381 days.

(21) Appl. No.: 12/908,080

(22) Filed: Oct. 20, 2010

(65) Prior Publication Data

US 2011/0120437 A1 May 26, 2011

Related U.S. Application Data

(60) Provisional application No. 61/254,074, filed on Oct. 22, 2009.

(51) Int. Cl.
*F41B 11/06* (2006.01)

(52) U.S. Cl.
USPC ..... 124/74

(58) Field of Classification Search ..... 124/73–76, 124/56, 60
See application file for complete search history.

(56) References Cited

U.S. PATENT DOCUMENTS

| | | | | | |
|---|---|---|---|---|---|
| 452,882 | A | * | 5/1891 | Giffard | 124/74 |
| 2,660,993 | A | * | 12/1953 | Blakeslee | 124/71 |
| 2,688,321 | A | * | 9/1954 | Martin | 124/74 |
| 2,817,328 | A | * | 12/1957 | Gale | 124/74 |
| 2,818,056 | A | * | 12/1957 | Martin | 124/72 |
| 3,119,384 | A | * | 1/1964 | Rudolf | 124/76 |
| 3,227,148 | A | * | 1/1966 | Spack | 124/76 |
| 3,527,194 | A | | 9/1970 | Vadas | |
| 3,788,298 | A | | 1/1974 | Hale | |
| 4,531,503 | A | | 7/1985 | Shepherd | |
| 5,280,778 | A | | 1/1994 | Kotsiopoulos | |
| 5,913,303 | A | | 6/1999 | Kotsiopoulos | |
| 5,962,805 | A | | 10/1999 | Saxby | |
| 6,470,872 | B1 | | 10/2002 | Tiberius et al. | |
| 6,601,780 | B1 | | 8/2003 | Sheng | |
| 6,701,909 | B2 | | 3/2004 | Tiberius et al. | |
| 6,892,718 | B2 | | 5/2005 | Tiberius et al. | |
| 2005/0155591 | A1 | | 7/2005 | Forster | |
| 2005/0188978 | A1 | | 9/2005 | Tiberius et al. | |

* cited by examiner

*Primary Examiner* — Michael Carone
*Assistant Examiner* — Reginald Tillman, Jr.
(74) *Attorney, Agent, or Firm* — Barnes & Thornburg LLP

(57) ABSTRACT

A non-lethal pistol for propelling projectiles, such as paintballs. The pistol has a body with a grip portion and a barrel. A canister of propellant received in the body to supply a valve assembly with propellant that is selectively vented to propel projectiles through the barrel. The pistol includes a firing mechanism adapted to actuate the valve assembly.

7 Claims, 18 Drawing Sheets

NON-LETHAL PISTOL

RELATED APPLICATIONS

The present application is related to and claims priority to U.S. Provisional Patent Application, Ser. No. 61/254,074, filed on Oct. 22, 2009, entitled "Non-Lethal Pistol." The subject matter disclosed in that provisional application is hereby expressly incorporated into the present application in its entirety.

TECHNICAL FIELD

This invention relates generally to non-lethal projectile launchers, such as paintball markers; in particular, the invention relates to a non-lethal pistol that is configured to launch projectiles, such as paintballs.

BACKGROUND

Devices that fire frangible projectiles are known in the art. For example, marking guns (commonly known as paintball guns or paintball markers) typically use compressed gas or combustible fuel to propel frangible projectiles. The frangible projectiles commonly have a gelatinous or plastic shell designed to break upon impact. Typically, the shells are filled with marking material, such as paint or an immobilizing material, such as a noxious chemical.

These types of devices have a wide variety of applications. For example, a popular recreational use is in paintball games, in which opposing sides attempt to seek out and "shoot" one another with paintballs. Frangible projectiles have also been used to segregate cattle within a herd. Likewise, law enforcement personnel employ frangible projectiles with immobilizing materials for crowd control. In some cases, the devices take the form of a pistol. However, the current non-lethal pistols available are, among other things, overly complex and in need of improvement.

SUMMARY

According to one aspect, the invention provides a non-lethal pistol. The pistol includes a body with a grip portion and a barrel. A canister of propellant received in the body and a valve assembly is configured to selectively vent gas to propel projectiles through the barrel. The pistol includes a firing mechanism adapted to actuate the valve assembly. The body includes a transverse front face through which projectiles are propelled out of the pistol. In one embodiment, the front face includes an opening dimensioned to receive the canister of propellant. For example, the canister of propellant could be laterally offset from the barrel. In some cases, for example, the canister of propellant might be disposed below the barrel. Embodiments are contemplated in which a longitudinal axis defined by the canister of propellant is substantially in parallel with a longitudinal axis of the barrel. Typically, an end cap dimensioned to be received by the opening. For example, the end cap could be coupled with the opening using a bayonet-style connection.

According to another aspect, the invention provides a non-lethal pistol comprising with a body with a barrel, a grip portion and a magazine releasably coupled with the grip portion. In one embodiment, the magazine has an internal cavity dimensioned to receive a plurality of projectiles. For example, the magazine may include a closed end and an open end through which projectiles exit the magazine. The pistol may include a biasing member a biasing member operatively associated with the magazine and a follower movable in the internal cavity of the magazine. In some embodiments, the follower is urged toward the open end by the biasing member to feed projectiles out of the magazine. An arm may be provided that is pivotable with respect to the follower for aiding the movement of a last projectile out of the magazine. A canister of propellant may be received in the body. The pistol includes a valve assembly configured to selectively vent gas to propel projectiles through the barrel. A firing mechanism actuates the valve assembly to propel projectiles out of the barrel. In one embodiment, the arm is configured to rotate as the follower feeds the last projectile out of the magazine. For example, the arm may include a projection that is received in a slot in the magazine to control rotation of the arm. In some cases, the slot includes a nonlinear position that rotates the arm due to the projection following the nonlinear portion of the slot.

According to a further aspect, the invention provides a body with a grip portion, a magazine received in the grip portion and a barrel through which projectiles are propelled. A canister of compressed gas is received in the body. The pistol includes a valve assembly configured to selectively vent gas to propel projectiles through the barrel. In one embodiment, the pistol includes a puncture assembly configured to open the canister of compressed gas. For example, the puncture assembly may include a piercing pin configured to move between a first position toward the canister of compressed gas and a second position away from the canister of compressed gas. Embodiments are contemplated in which a firing mechanism is configured to actuate the valve assembly and the puncture assembly. For example, the firing mechanism could include a cam surface that moves the piercing pin toward the canister of compressed gas when the firing mechanism is actuated.

According to yet another aspect, the invention provides a method for launching a projectile from a non-lethal pistol. A non-lethal pistol is provided with a valve assembly configured to vent gas to propel projectiles out of a barrel. An unused canister of compressed gas is inserted into the non-lethal pistol. When an initial trigger pull is made, the non-lethal pistol releases a supply of compressed gas from the unused canister to the valve assembly; however, the valve assembly does not include a supply of compressed gas to vent responsive to the initial trigger pull. When a subsequent trigger pull is made, the non-lethal pistol vents compressed gas supplied to the valve assembly responsive to the initial trigger pull to propel projectiles from the non-lethal pistol. Typically, the initial trigger pull pierces the unused canister of compressed gas, but does not fire a projectile. Instead, projectiles are fired on subsequent trigger pulls.

Additional features and advantages of the invention will become apparent to those skilled in the art upon consideration of the following detailed descriptions exemplifying the best mode of carrying out the invention as presently perceived.

BRIEF DESCRIPTION OF DRAWINGS

The present disclosure will be described hereafter with reference to the attached drawings which are given as non-limiting examples only, in which.

Figure 1:
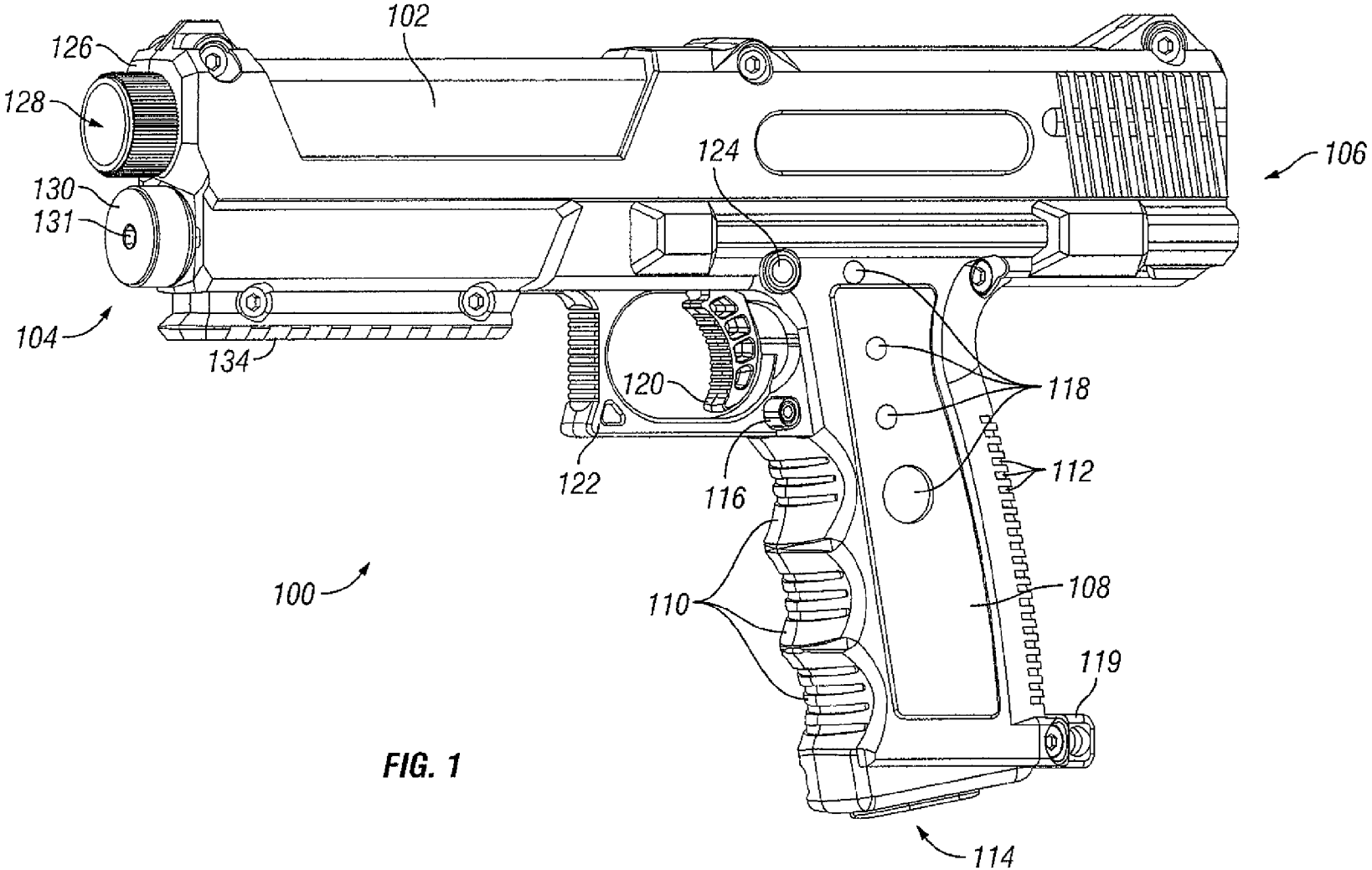
FIG. 1 is a left side perspective view of an example pistol according to an embodiment of the invention.

Corresponding reference characters indicate corresponding parts throughout the several views. The components in the Figures are not necessarily to scale, emphasis instead being placed upon illustrating the principles of the invention. The exemplification set out herein illustrates embodiments of the invention, and such exemplification is not to be construed as limiting the scope of the invention in any manner.

DETAILED DESCRIPTION OF THE DRAWINGS

While this invention is susceptible to embodiment in many different forms, this specification and the accompanying drawings disclose only preferred forms as examples of the invention. The invention is not intended to be limited to the embodiments so described, however.

FIG. 1 shows an example non-lethal pistol 100 that is capable of propelling projectiles toward a target. Although a paintball pistol is shown for purposes of illustration, the principles described in this disclosure may also be used in other projectile launchers, such as devices designed to fire traditional pellets and BBs, non-traditional varieties of these projectiles, and other types of projectiles, as well. It should be appreciated that the pistol 100 could use a variety of propellants to propel paintballs (or other projectiles). The term "propellant" is broadly intended to encompass both compressed gas, such as carbon dioxide and nitrogen, as well as combustible fuel, such as propane, butane, and methylacetylene-propadiene ("MAPP"). An example of a compressed gas-powered launcher includes U.S. Pat. No. 5,722,383 filed Dec. 1, 1995, for an "Impeder for a Gun Firing Mechanism with Ammunition Feeder and Mode Selector," the entire disclosure of which is incorporated by reference. Another example of a compressed gas-powered launcher includes U.S. application Ser. No. 12/102,535 for a "Projectile Launcher with Reduced Recoil and Anti-Jam Mechanism" filed Apr. 14, 2008, which is also hereby incorporated by reference. An example of a combustible fuel-powered launcher includes Pre-grant Publication No. 2008/0190275 filed Aug. 15, 2007, for a "Projectile Launcher," which is hereby incorporated by reference. The pistol 100 could be implemented as a manual, semi-automatic, or automatic pistol, even though a semi-automatic pistol is shown for purposes of illustration.

As shown in FIG. 1, the pistol 100 has a body 102 with a front portion 104 and a rear portion 106. The body 102 defines an interior cavity to house internal components of the pistol 100. In this example, the body 102 includes a grip 108 for the user to grasp the pistol 100. In the example shown, the grip 108 includes optional indentations 110 for receiving a user's fingers to prevent lateral movement during firing. The grip 108 (and other portions of the body 102) may include surface ornamentation 112 to create a rough surface to reduce slippage while handling the pistol 100. For example, the grip 108 may include portions with a knurled surface or other surface ornamentation to reduce slip. A magazine 114 for holding a plurality of projectiles may be releasably received by the grip 108. In this example, a release mechanism 116 is provided to release the magazine 114 from the grip 108 so that projectiles can be added and/or removed from the magazine 114. For purposes of example, the release mechanism 116 is shown as a push button that releases the magazine 114. In the example shown, the grip 108 includes one or more windows 116 through which a user may see how many projectiles are left in the magazine 114. For example, the windows 118 may be transparent or translucent portions of the grip 108. As shown, the grip 108 includes an extension 119 with a hole for receiving a lanyard clip.

In the embodiment shown, the grip 108 is adjacent a trigger 120 for actuation by the user to fire the pistol 100. Embodiments are contemplated in which the trigger 120 may mechanically and/or electrically fire the pistol 100. In the example shown, the trigger 120 is surrounded by a trigger guard 122 to prevent accidental firing of the pistol 100. As shown, a safety 124 is also provided to prevent inadvertent firing. The safety 124 prevents the pistol 100 from firing in a safe position and allows the pistol 100 to fire projectiles in the firing position. Although the example shown includes a push button for actuating the safety 124, it should be appreciated that other forms of safeties could be used.

The front portion 104 includes a transverse front face 126. In the example shown, the front face 126 defines an opening for a barrel 128 through which projectiles are propelled. Typically, the barrel 128 is coupled with the body 102, such as using external threads that may be received by internal threads in the body 102. As used herein, the term "coupled" is broadly intended to encompass both direct and indirect connections. By way of other examples, the barrel 128 may be coupled with the body 102 using an interference fit, frictional fit, or unitary formation.

In the example shown, the front face 126 also defines a hole for an end cap 130. The end cap 130 may be opened to allow access to a canister of propellant 132 (see FIGS. 3-8). By way of example only, the canister 132 could be a 12 gram canister of compressed gas, such as carbon dioxide. As shown, the longitudinal axis of the canister 132 is approximately parallel with the longitudinal axis of the barrel. For example, the canister 132 may be positioned below the barrel to provide easy access and ease design/cost of the magazine 114. In one embodiment, the end cap 130 may include a recess 131, such as for receiving a hex wrench, to aid in opening/closing the end cap 130. In the example shown, a rail 134 is provided for attachment of a light or other accessories.

Figure 2:
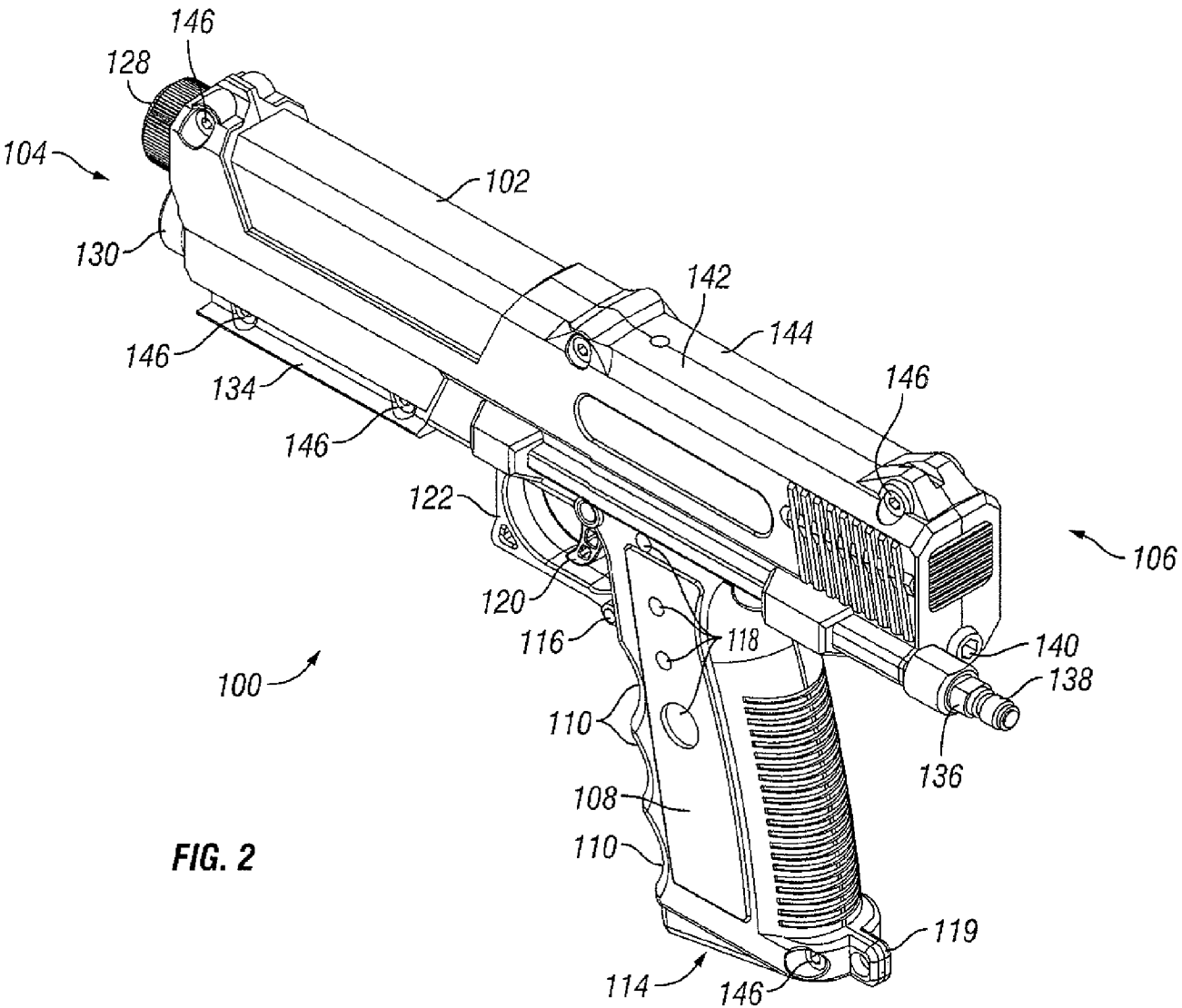
FIG. 2 is a left side perspective view of the example pistol shown in FIG. 1, with a remote line attachment.

FIG. 2 shows the example pistol 100 with an optional remote line attachment 136. In this embodiment, a bib 138 may be used to connect an external source of propellant. The embodiment shown also includes a velocity adjustment 140 for controlling the speed at which projectiles are fired from the pistol 100. In this embodiment, the body 102 has a clamshell style with a left side 142 and a right side 144 that are coupled together with pins 146.

Figure 3:
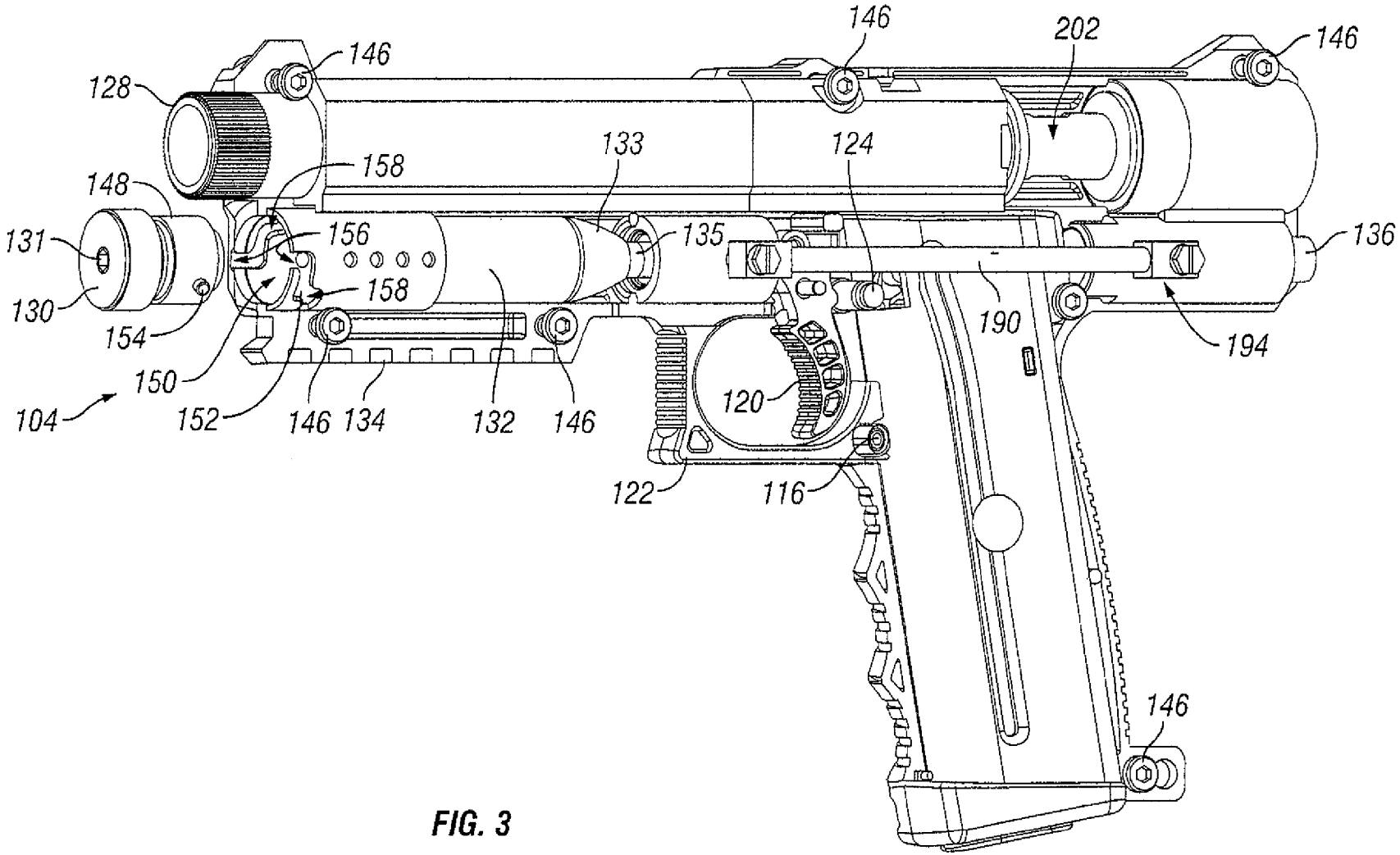
FIG. 3 is a left side perspective view of the example pistol shown in FIG. 1 with a portion of the body removed to show internal components.

FIG. 3 shows the example pistol 100 with a portion of the body 102 cut away to reveal some internal components. In the example shown, the end cap 130 includes a reduced diameter portion 148 that is received by an opening 150 in the body 102 in which the canister 132 may be disposed. The opening 150 includes slots 152 that are dimensioned to receive one or more projections 154, similar to a bayonet-style connector. It should be appreciated that the end cap 130 could be coupled with other interference or frictional fits. In the example shown, the slots 152 define a path with a first segment 156 and a second segment 158. In this example, the end cap 130 is received by the opening 150 in two stages in which the projections 154 travel through the first segment 156 and then the second segment 158. First, the end cap 130 is inserted into the opening 150 with the projections 154 received by the slots 152 in the first segment 156 and the end cap 130 is rotated. Second, the end cap 130 is inserted further and rotated again via the second segment 158. This provides a safety mechanism to prevent removal of the end cap 130 due to accidental pressure build up within the body 102. Additionally, insertion of the end cap 130 secures the canister 132 within the opening against a piston as discussed below with respect to FIGS. 4 and 5. In the example shown, the canister 132 has a sloped neck 133 that terminates in a mouth 135. Typically, the mouth 135 would include a seal, such as a foil, to prevent escape of compressed gas from the canister 132.

Figure 4:
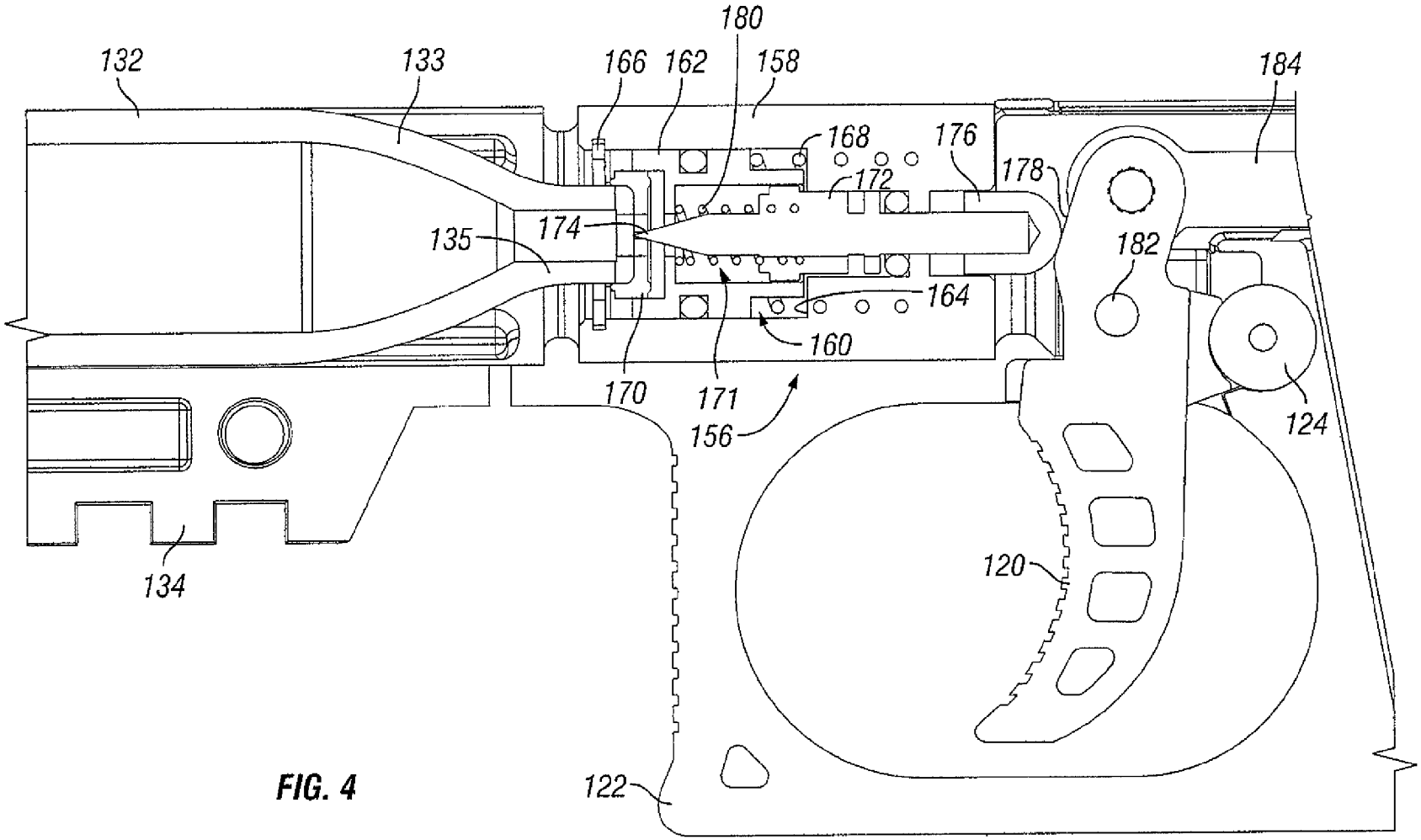
FIG. 4 is a detailed left side view of the pistol with a portion of the body removed to show an example puncture assembly according to one embodiment prior to the trigger being pulled.
Figure 5:
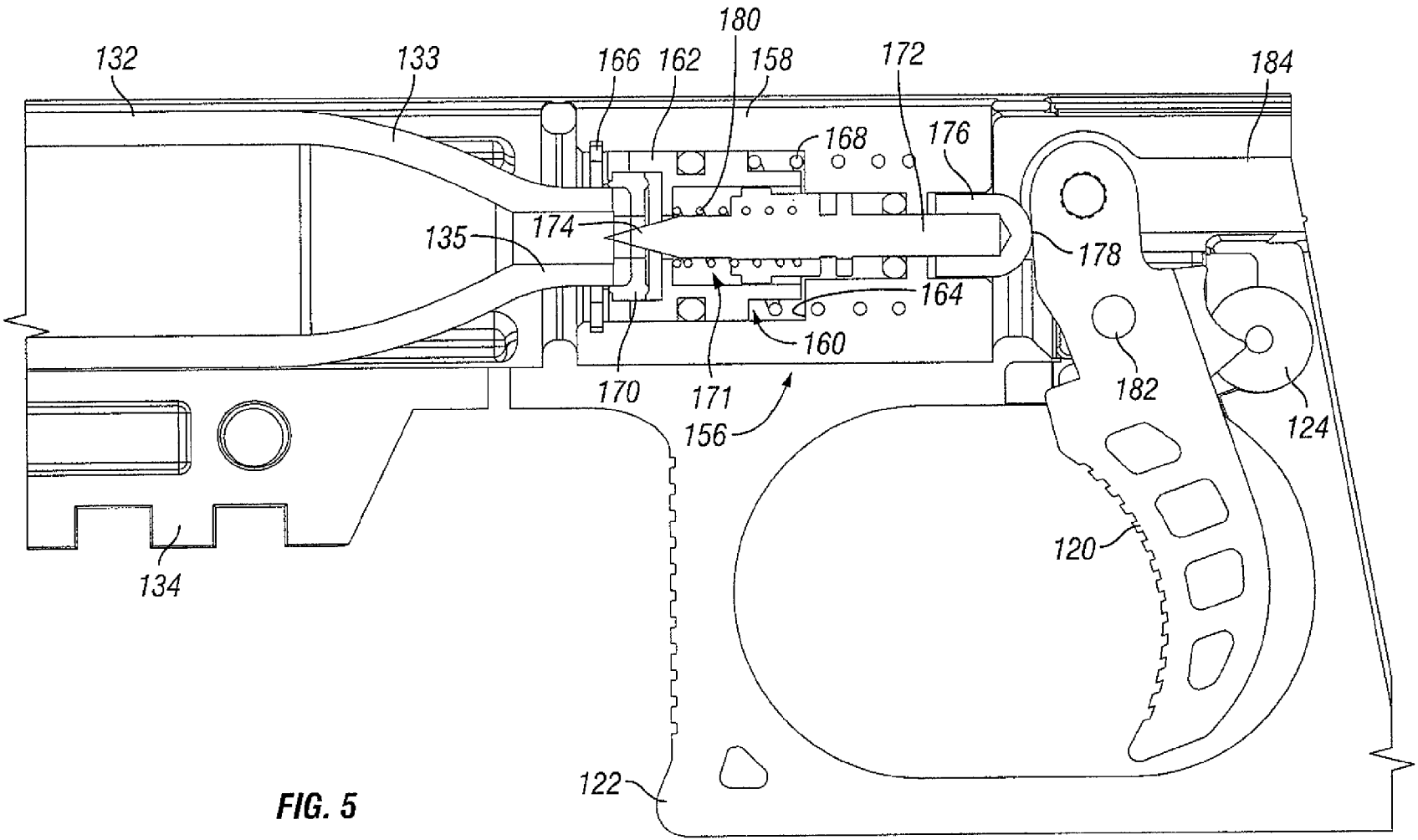
FIG. 5 is a detailed left side view of the puncture assembly shown in FIG. 4 during a trigger pull.

FIGS. 4 and 5 show an example puncture assembly 156 for releasing the propellant from the canister 132 to the pistol's 100 valve assembly for use in propelling projectiles. In the embodiment shown, the puncture assembly 156 includes a puncture assembly body 158 with a cavity 160 that includes a piston 162 that is movable within the cavity. A ledge 164 in the puncture assembly body 158 limits rearward movement while a snap ring 166 limits forward movement of the piston 162. A biasing member 168 urges the piston 162 forward toward the mouth 135 of the canister 132. A seal 170 is received within a recess on a leading end of the piston 162, which provides a seal with the mouth 135 of the canister 132. The urging action of the biasing member 168 aids in providing secure contact between the seal 170 and the canister's 132 mouth 135.

A piercing pin 172 is received within a cavity 171 defined by the piston 162 and extends through a recess defined by the puncture assembly body 158. As shown, the piercing pin 172 has a first end with a tip 174 that is sufficiently sharp to pierce foil covering the mouth 135 of the canister 132, thereby releasing compressed gas. At a second end, the piercing pin 172 includes a head 176 that is actuated by a cam surface 178 of the trigger 120. Prior to pulling the trigger 120 (FIG. 4), a biasing member 180 urges the piercing pin 172 rearward away from the canister's 132 mouth 135. When the trigger 120 is pulled (FIG. 5), in the example shown, the trigger 120 pivots about a pin 182, which moves the cam surface 178 to impart sufficient force on the head 176 to overcome the biasing member 180, which moves the piercing pin 172 sufficiently to pierce the foil covering the mouth 135 of the canister 132 to release compressed gas from the canister 132. The trigger is also connected with a linkage 184 for actuating the valve assembly 202 (FIGS. 7 and 8) to propel a projectile.

The operation of delivering propellant from the canister 132 to the valve assembly 202 according to the embodiment shown in FIGS. 4 and 5 will now be discussed. FIG. 4 shows an unused canister 132 of propellant that has been inserted into the opening 150 and secured in place by closing the end cap 130. When the canister 132 is inserted into the opening 150, the mouth 135 is adjacent to the seal 170 in the piston 162. By closing the end cap 130, the canister 132 may overcome the biasing member 168 to be secured between the piston 162 and the end cap 130. If the user does not pull the trigger 120, which would pierce the foil sealing the canister's 132 mouth 135, the unused canister 132 could be removed from the opening 150 and used at a later date.

When the user pulls the trigger 120 for the first time after inserting the canister 132, the pistol 100 will not fire because the propellant has not been previously supplied to the valve assembly 202 in the embodiment shown. Instead, the action of the cam surface 178 on the head 176 will overcome the biasing member 180 to move the piercing pin 172 sufficiently so the tip 174 will pierce the foil covering the mouth 135 of the canister 132, thereby releasing the propellant to the valve assembly 202. Since propellant is supplied to the valve assembly (after the initial trigger pull), the next pull on the trigger 120 will fire a projectile.

Figure 6A:
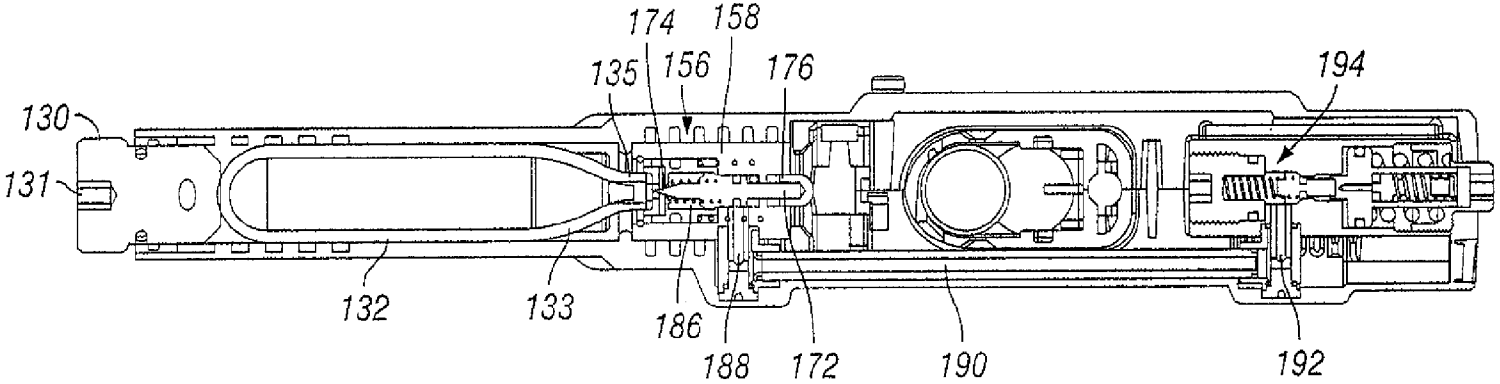
FIG. 6A is a top cross-sectional view of the example pistol shown in FIG. 1.
Figure 6B:
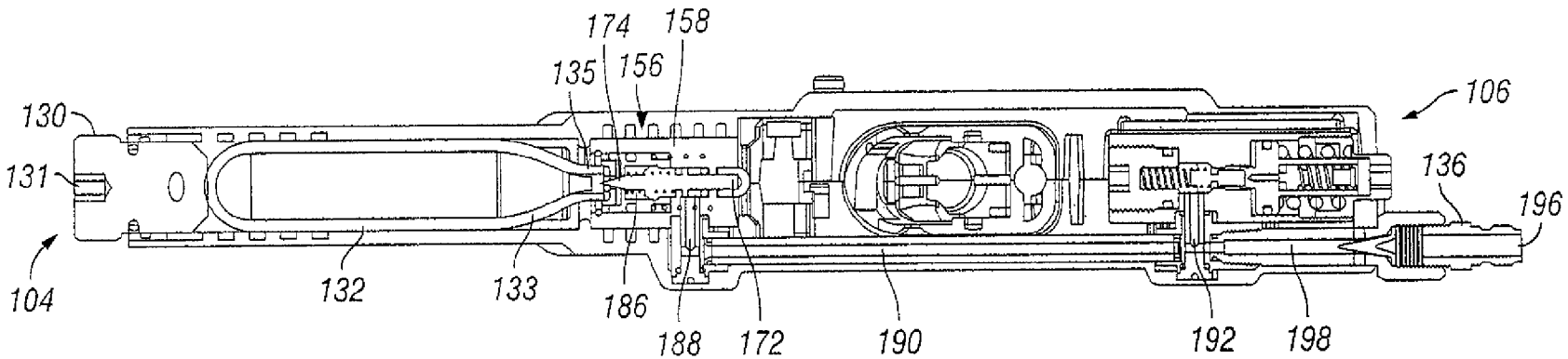
FIG. 6B is a top cross-sectional view of the example pistol shown in FIG. 2 with the remote line attachment.

As best seen in FIG. 6A, in the embodiment shown, the propellant released from the canister 132 flows into a first passage 186, into a second passage 188, through a third passage 190, into a fourth passage 192, which is an inlet to a valve assembly, which may optionally include a regulator 194 to regulate the propellant's pressure. FIG. 6B is a cross-sectional view showing the flow path to the valve assembly if the remote line attachment 136 is used, such as shown in FIG. 2. In this embodiment, the propellant is supplied by an external source (not shown) to a remote line port 196. The propellant from the external source flows in a remote line passage 198 to the fourth passage 192, which is an inlet to a valve assembly, as discussed above. As shown, an empty canister 132 is disposed within the opening 150 to seal the opening 150 from leakage of propellant around the end cap 130 due to the seal 170 blocking flow around the canister 132.

Figure 7:
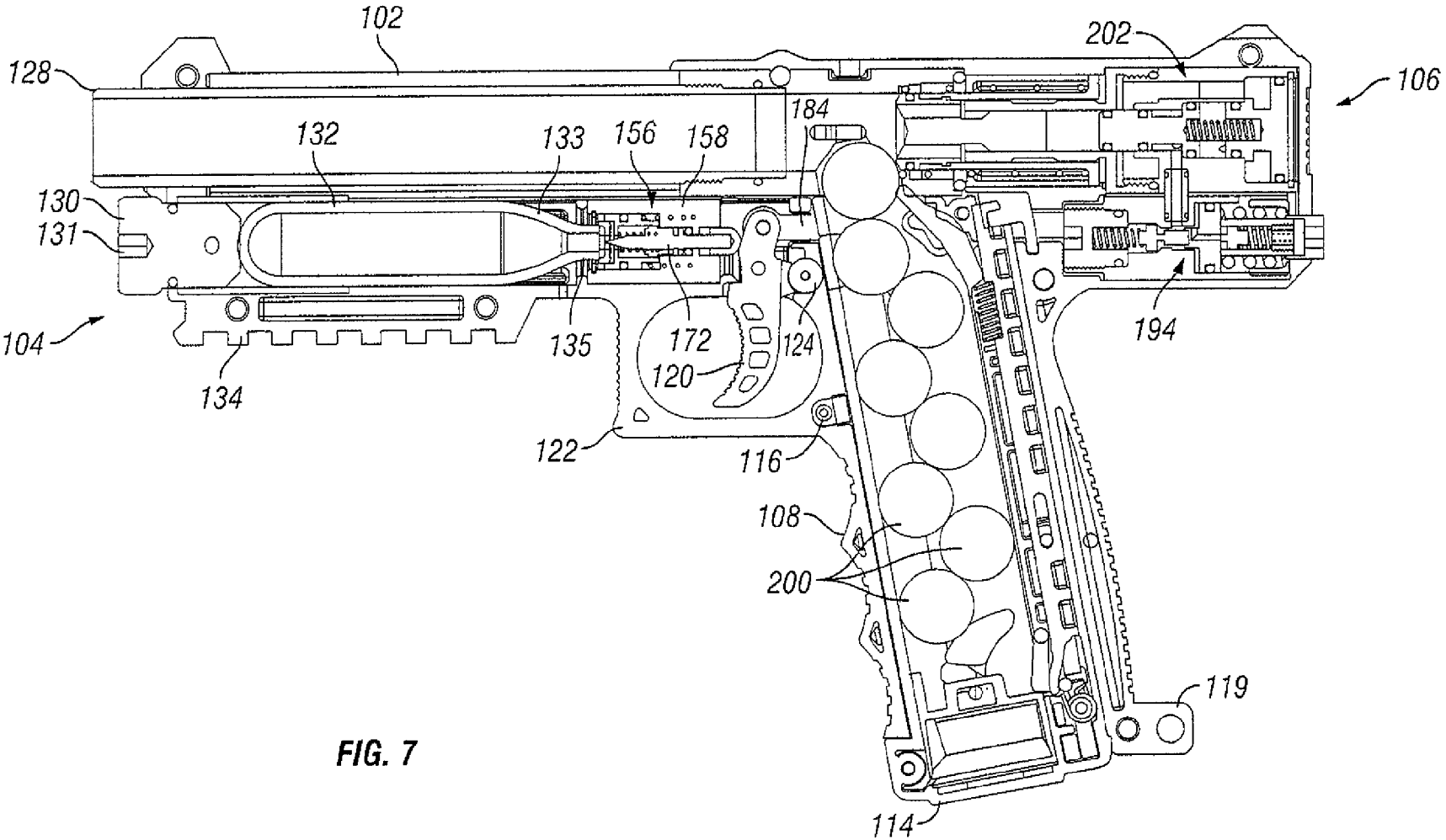
FIG. 7 is a side cross-sectional view of the example pistol shown in FIG. 1 prior to pulling the trigger.
Figure 8:
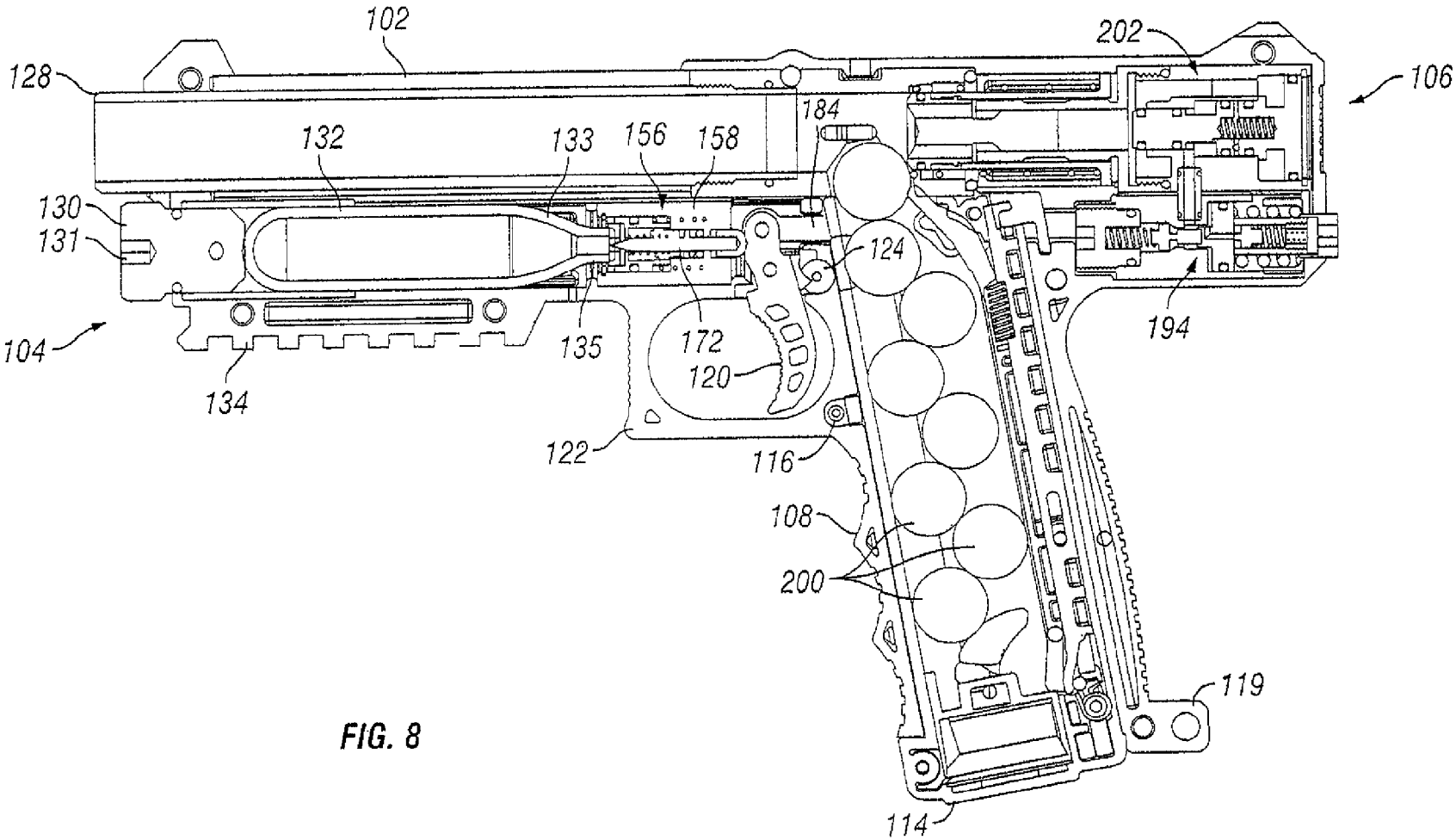
FIG. 8 is a side cross-sectional view of the example pistol shown in FIG. 1 during a trigger pull.

FIGS. 7 and 8 are side cross-sectional views of the pistol 100 before and after pulling the trigger 120, respectively. In the embodiment shown, the magazine 114 with a plurality of projectiles 200, such as paintballs, can be seen. Although this example shows eight projectiles, it should be appreciated that more or less projectiles could be provided in the magazine 114. As discussed above, a release mechanism 116 is provided to release the magazine 114 from the pistol 100 for loading/removing projectiles. An example valve assembly 202 can also be seen, which is actuated by the trigger 120, as discussed in more detail with respect to FIGS. 13-16. In this embodiment, the valve assembly 202 is actuated by the linkage 184.

Figure 9:
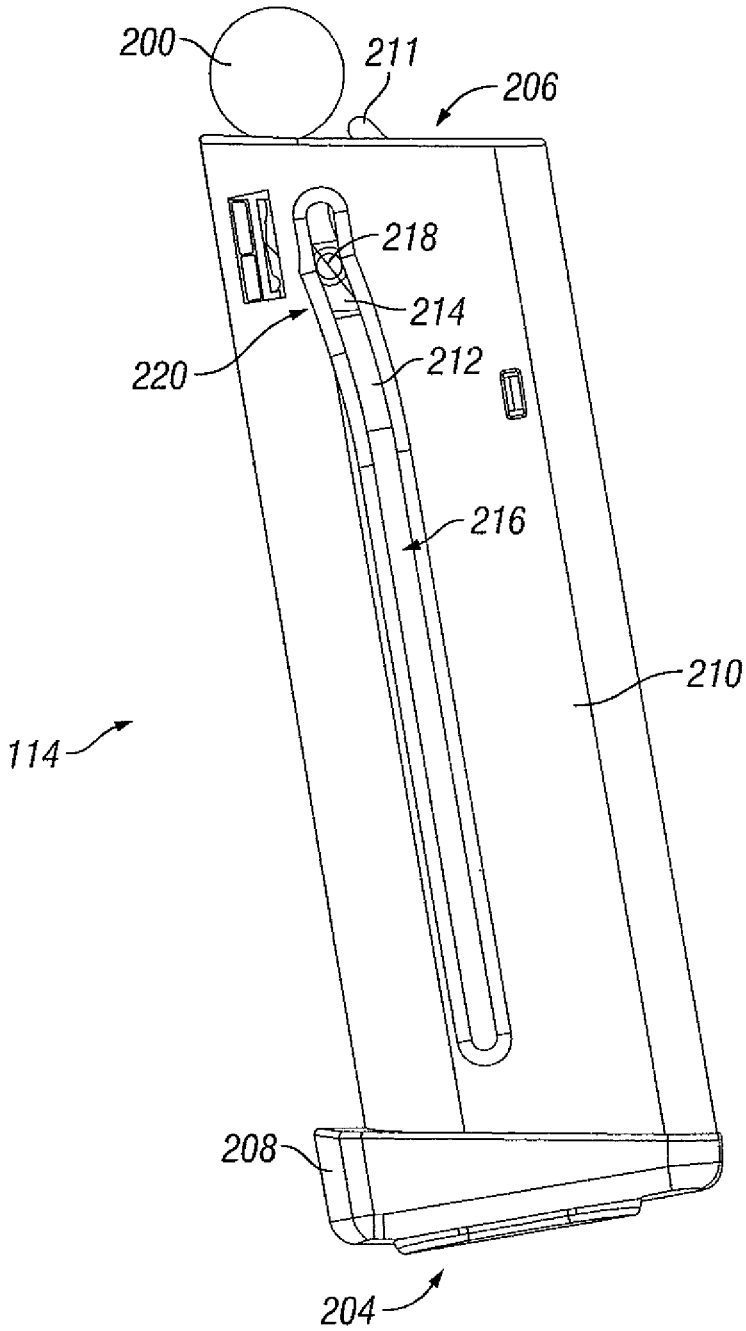
FIG. 9 is a side perspective view of an example magazine that could be used with the pistol according to one embodiment of the invention.

FIG. 9 is a side perspective view of an example magazine 114 released from the pistol 100. In the example shown, the magazine 114 has a closed lower end 204 and an open upper end 206. As shown, the magazine includes a bottom portion 208 that extends from the grip 108; in the embodiment shown the bottom portion 208 is dimensioned to have a substantially continuous exterior surface with the grip 108. As shown, the magazine 114 has a reduced dimension body 210 between the upper end and the bottom portion 208. A cavity is defined in the body 210 for receiving a plurality of projectiles. A latch 211 may be provided to limit movement of the leading projectile prior to firing.

Figure 10:
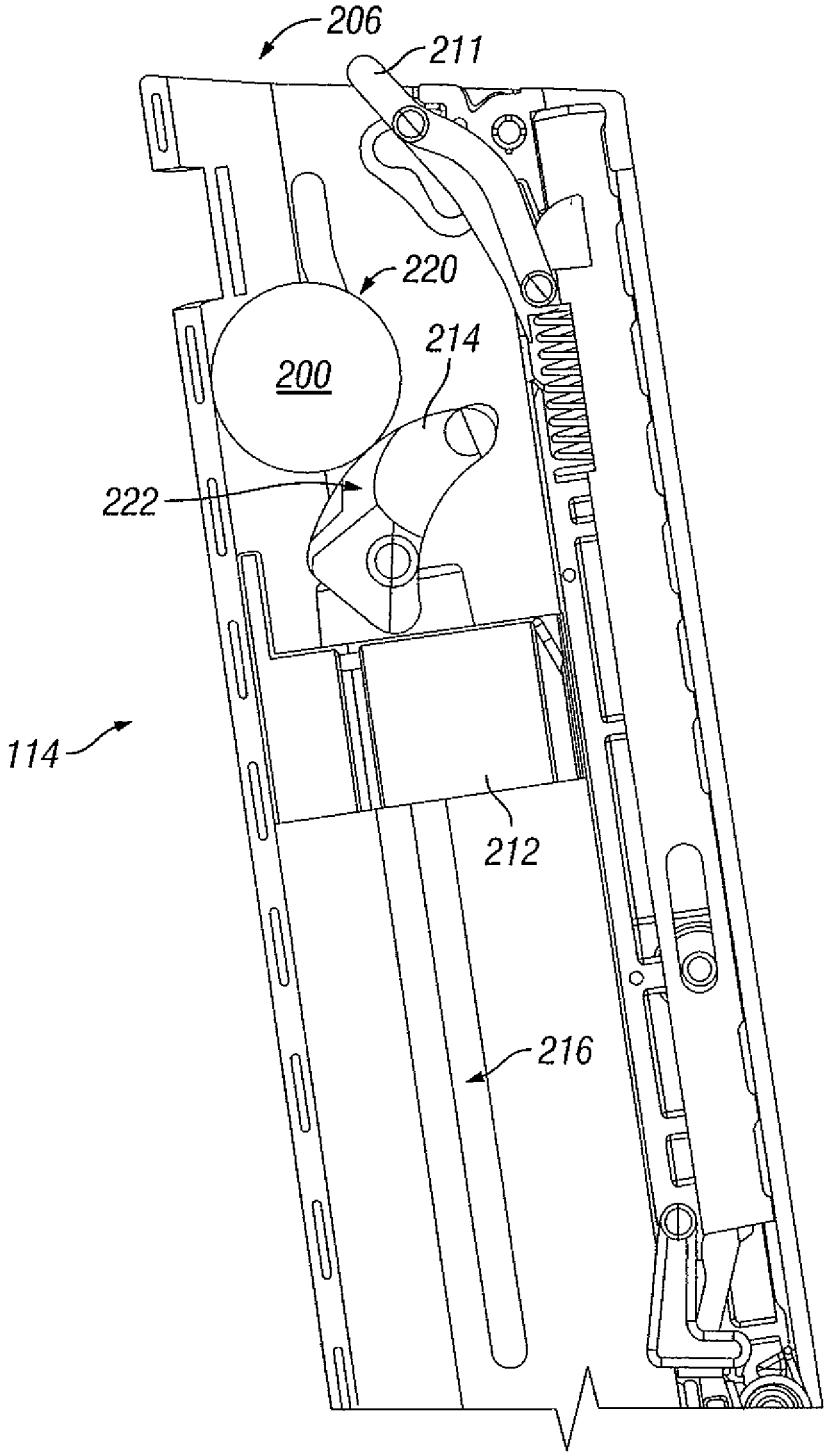
FIG. 10 is a detailed side cross-sectional view of the example magazine shown in FIG. 9.
Figure 11:
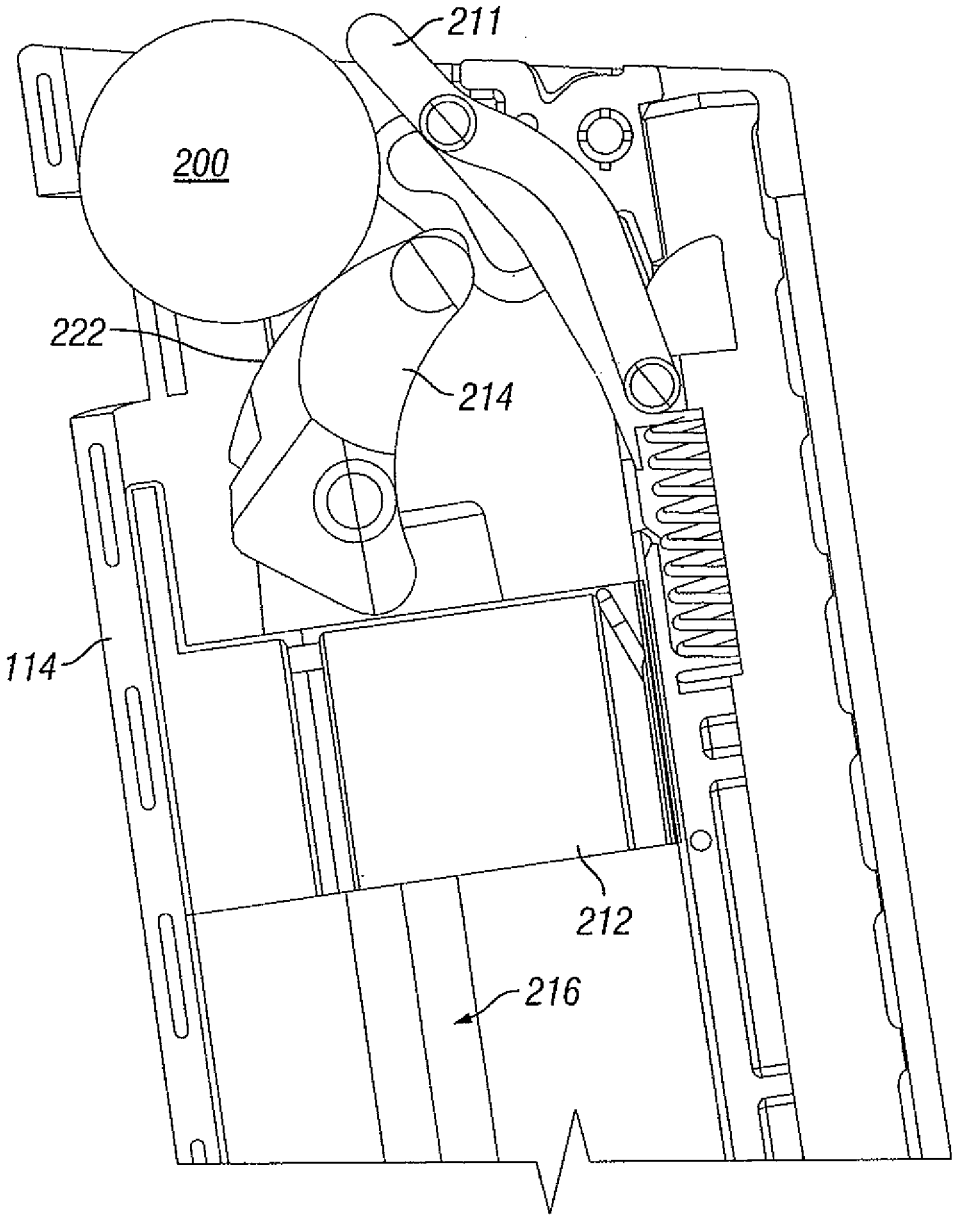
FIG. 11 is a detailed side cross-sectional view of the example magazine shown in FIG. 9 showing initial rotation of the follower's arm.
Figure 12:
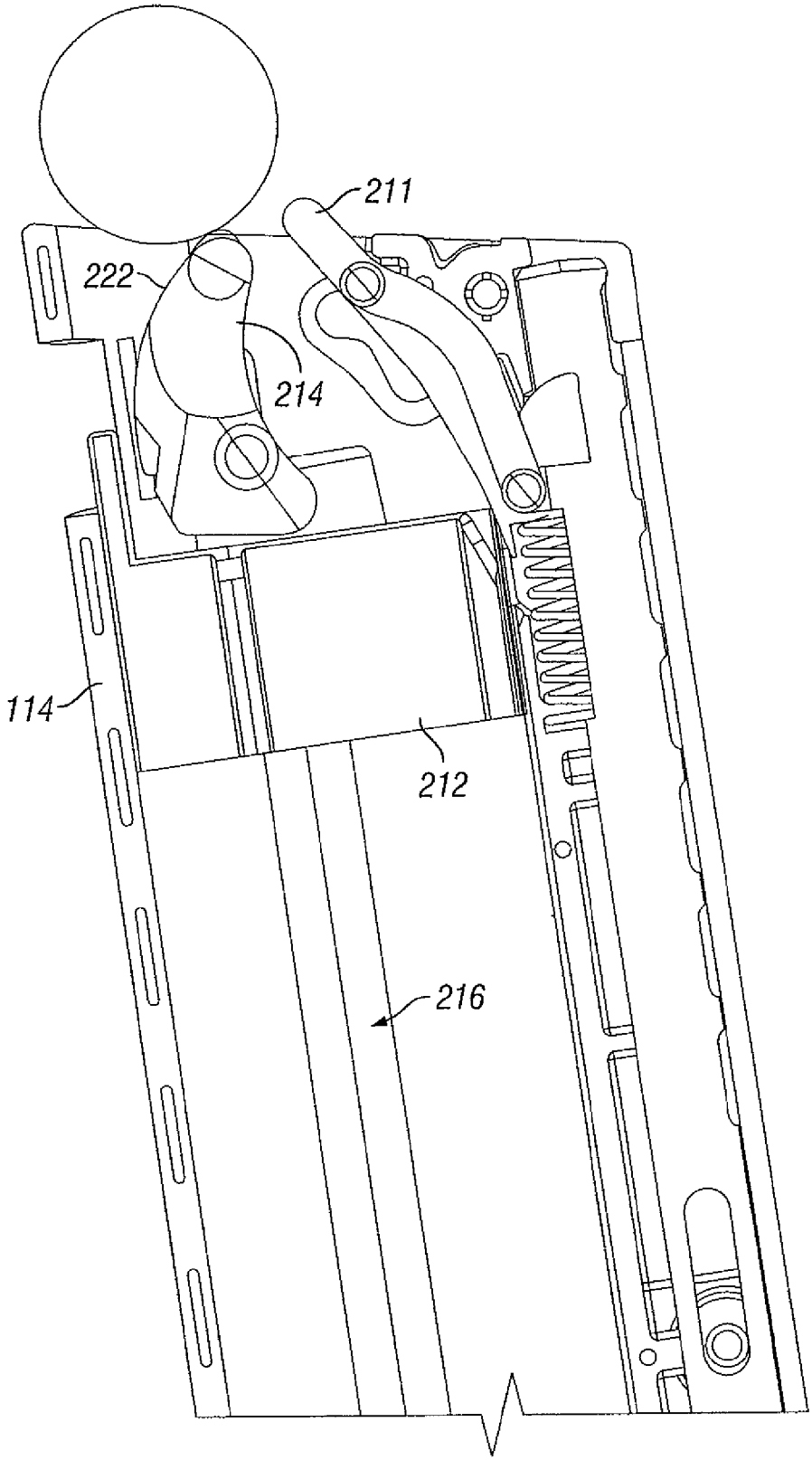
FIG. 12 is a detailed side cross-sectional view of the example magazine shown in FIG. 9 showing continued rotation of the follower's arm.

A follower 212 (best seen in FIGS. 10-12) is movable within the cavity to feed projectiles through the open end 206 to a firing position. Typically, a biasing member (not shown) urges the follower 212 toward the open upper end 206, which feeds projectiles toward a firing position. An arm 214 is pivotable with respect to the follower 212 for aiding the movement of the last projectile in the magazine 114 toward a firing position. In this embodiment, a slot 216 is defined in the body 210 that receives a projection 218 of the arm 214. As shown, the slot 216 includes a curved or nonlinear portion 220 that rotates the arm 214 due to the projection 218 following the nonlinear portion 220 of the slot 216, which aids in moving the last projectile toward a firing position. FIGS. 10-12 show movement of the follower 212 in the cavity defined by the body 210. The projection's 218 movement in the nonlinear portion 220 of the slot 216 causes rotation of the arm 214, which aids in moving the remaining projectile toward a firing position. In the example shown, the arm 214 includes a curved surface 222 for pushing the last projectile toward the firing position.

Figure 18:
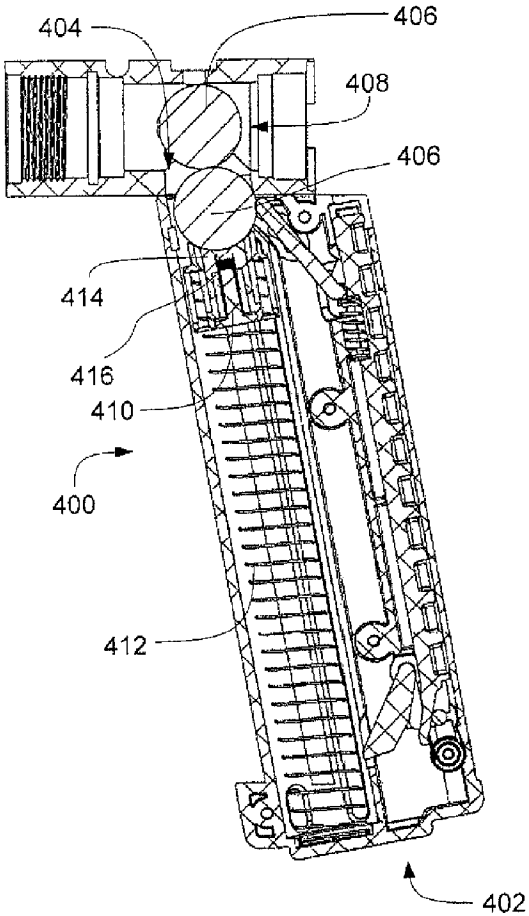
FIGS. 17-20 show an example magazine that could be used with the pistol according to another embodiment of the invention.
Figure 20:
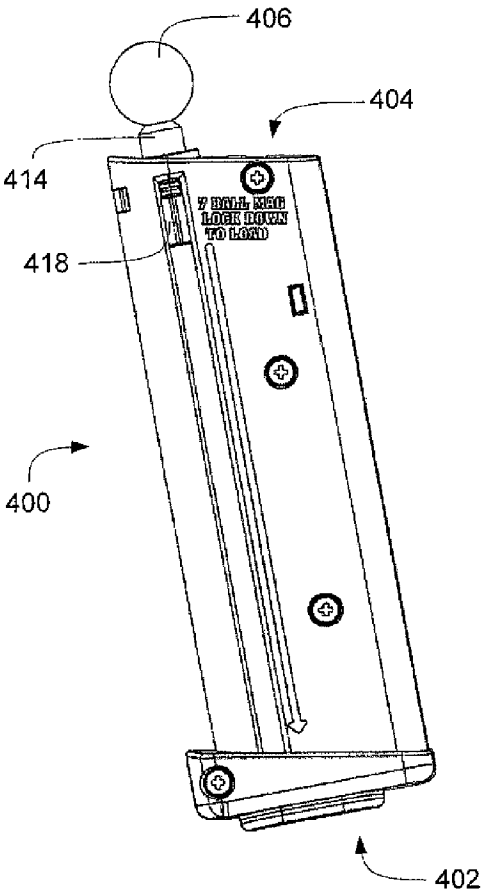
Figure 19:
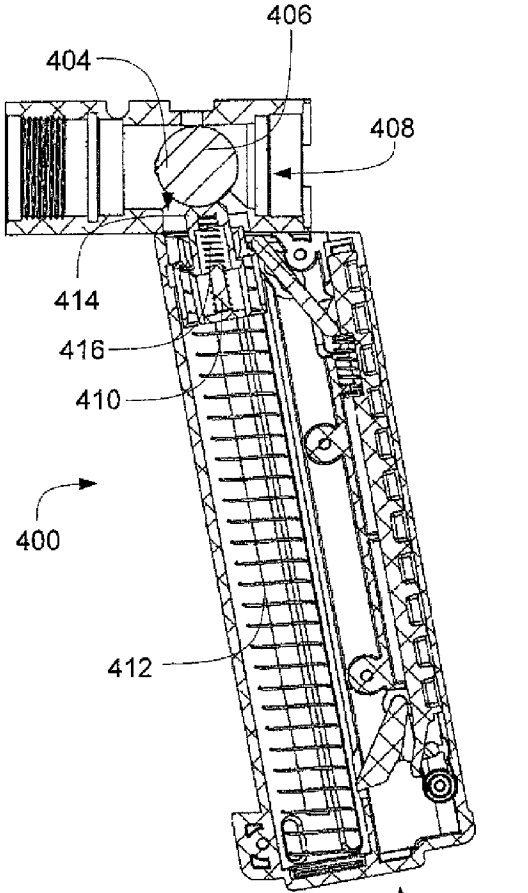

FIGS. 17-20 show an example magazine 400 according to another embodiment. In the example shown, the magazine 400 has a closed lower end 402 and an open upper end 404 through which projectiles 406, such as paintballs, exit the magazine 400. In this example, the projectiles 406 are sequentially fed into a breech portion 408 (FIGS. 18-19) for firing. As shown, a follower 410 is movable between a fully loaded position (FIG. 17) and a fully extended position (FIGS. 19-20) to push projectiles 406 into the breech portion 408. Typically, the follower 410 is urged toward the open end 404 using a biasing member, such as a spring 412. In this example, the follower 410 includes a projection 414 that is movable between a retracted position (FIGS. 17-18) to an extended position (FIGS. 19-20). As shown, a biasing member 416 (best seen in FIG. 19) urges the projection 414 to an extended position toward the open end 404. During loading of the magazine 400, the insertion of projectiles into the magazine 400 overcomes the biasing member 414 to move the projection 414 to the retracted position. This movement to the retracted position allows an extra projectile 406 to be inserted into the magazine. Embodiments are also contemplated in which the projection 414 could be fixed, but this would reduce the number of projectiles that could fit into the magazine 400. When the magazine 400 is inserted into the pistol 100, the projection 414 remains in the retracted position until the last projectile 406 exits the magazine 400. When this happens, in this embodiment, the projection 414 moves to the extended position to aid the last projectile out of the magazine 400.

Figure 17:
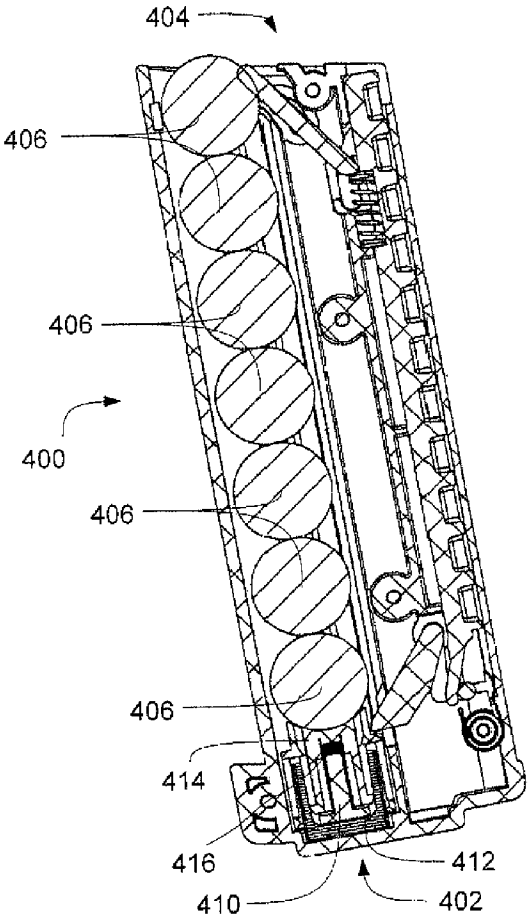

FIG. 17 is a left side cross-sectional view of the magazine 400 fully loaded with projectiles 406. Although seven projectiles 406 are shown for purposes of example, it should be appreciated that more or less projectiles 406 could be provided as desired. As shown, the projection 414 is in the retracted position, which allows extra space within the magazine 400 for projectiles 406.

FIG. 18 is a left side cross-sectional view of the magazine 400 after a few projectiles have been fired and so there are two projectiles remaining in this example. As shown, the follower 410 has moved from its position in FIG. 17 toward the open end 404 due to the urging of the spring 412 when projectiles 406 are fired. In this example, the projection 414 is in the retracted position.

FIG. 19 is a left side cross-sectional view of the magazine 400 after all projectiles have been fired, except one remaining projectile 406. In this example, since only one projectile 406 remains, the projection 414 has moved to the extended position due to the urging of the biasing member 416. This movement aids the projectile 406 in exiting the magazine 400 so that it is fully within the breech portion 408. FIG. 20 is a left side view of the magazine 400 with the follower 410 in the position shown in FIG. 19. As shown, the follower 410 includes an extension 418 that allows the user to move the follower 410 away from the open end so that projectiles 406 can be loaded into the magazine 400.

Figure 13:
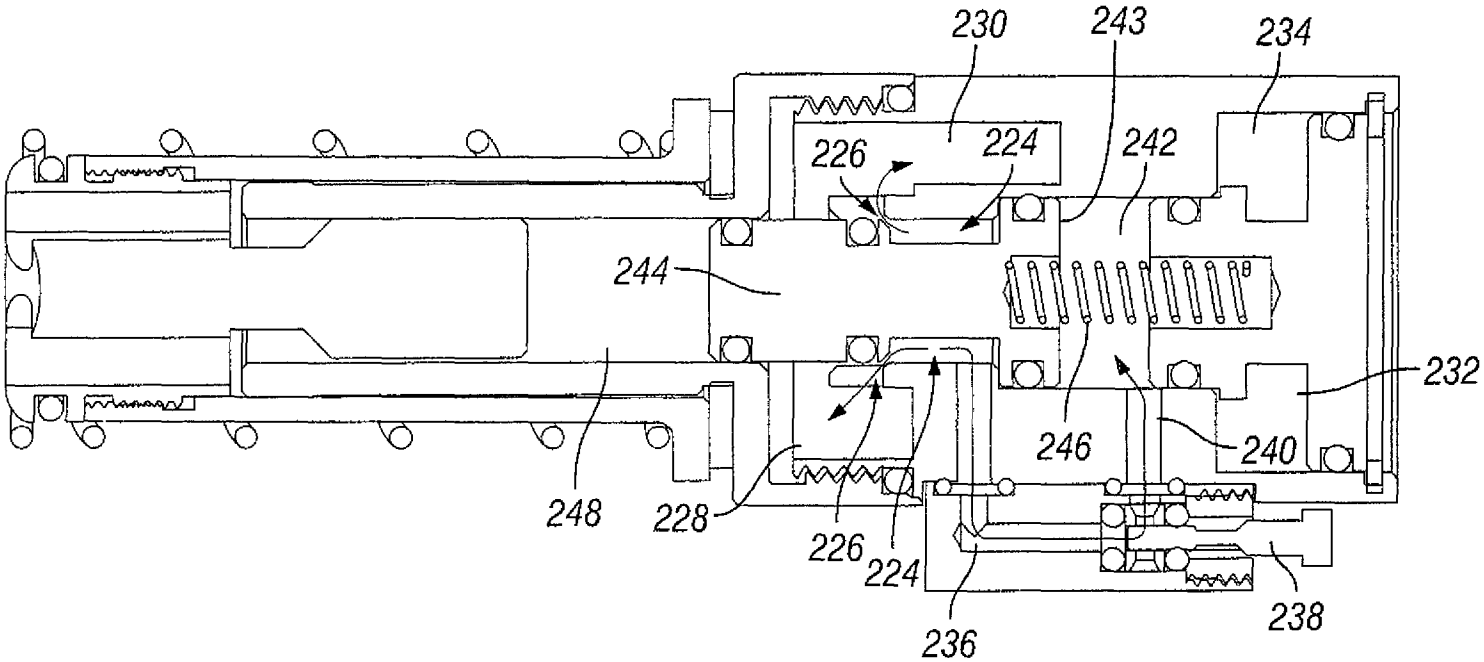
FIGS. 13 and 14 are side cross-sectional views of an example valve assembly that could be used with the pistol, showing the valve assembly position prior to pulling the trigger.
Figure 14:
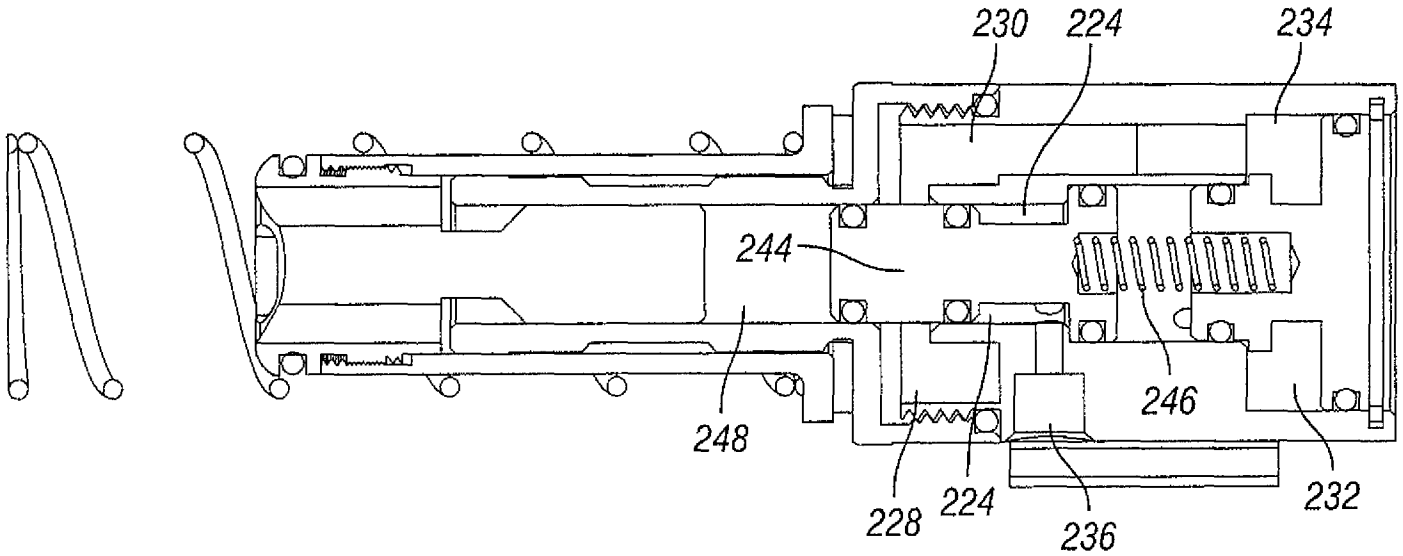

Referring now to FIGS. 13 and 14, a side cross-sectional view of an example valve assembly 202 is shown that could be used to propel projectiles from the pistol 100 prior to pulling the trigger 120. After the trigger is pulled the first time to pierce the canister 132 and release propellant, as discussed above, the propellant enters the valve assembly 202 at inlet 224. The propellant passes through an opening 226 into a first chamber 228 and a second chamber 230, which are in fluid communication with a third chamber 232 and a fourth chamber 234. The propellant also flows from the inlet 224 through a first passageway 236. Prior to pulling the trigger 120, a firing valve 238 allows flow from the first passageway 236 to a second passageway 240. This allows the propellant to flow into a fifth chamber 242, which acts on a surface 243 of a valve 244. Due to the area of surface 243 and a biasing member 246, the valve 244 is in a closed position, which blocks flow from the first, second, third, and fourth chambers 228, 230, 232, and 234 to a firing passageway 248.

Figure 15:
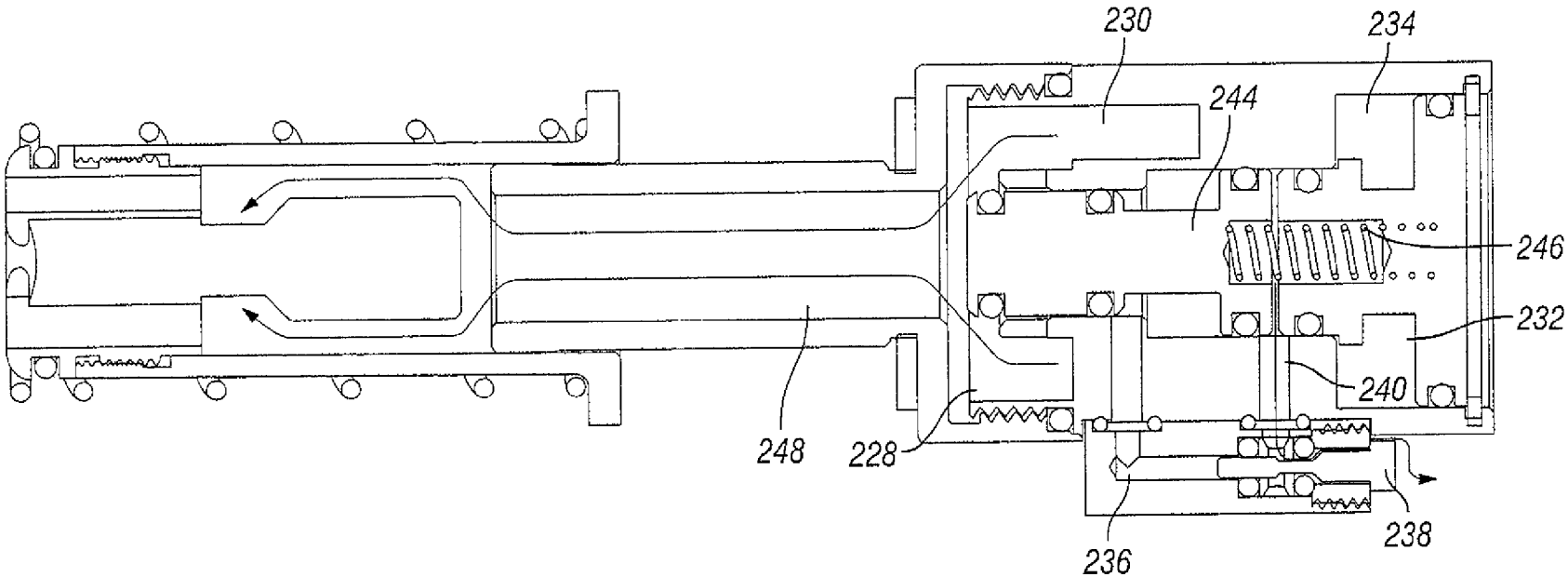
FIGS. 15 and 16 show the example valve assembly of FIGS. 13 and 14 after pulling the trigger to propel a projectile from the pistol.
Figure 16:
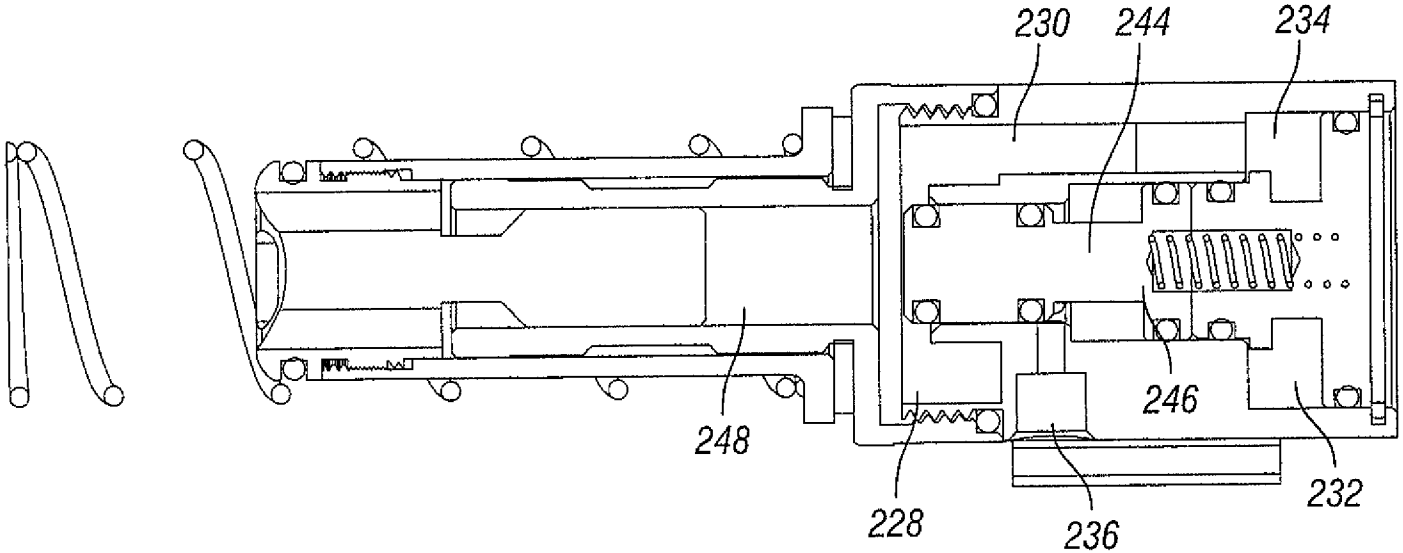

FIGS. 15 and 16 show the example valve assembly of FIGS. 13 and 14 after pulling the trigger 120. When the trigger 120 is pulled, the linkage 184 (see FIG. 7) actuates the firing valve 238, which moves the firing valve 238 to a position that blocks the flow between the first passageway 236 and the second passageway 240. The firing valve's 238 position allows flow from the second passageway 240 to the atmosphere. Due to the decrease of pressure within the fifth chamber 242, the valve 244 shifts (to the right in this example), which allows flow between the first, second, third, and fourth chambers 228, 230, 232, 234 and the firing passageway 248 to propel a projectile from the pistol 100. The shift of the valve 244 also blocks the opening 226 to prevent additional supply of propellant during firing. When the pressure decreases, the force of the biasing member shifts the valve 244 back to the position shown in FIGS. 13 and 14. As discussed above, this position allows flow into the first, second, third, fourth, and fifth chambers 228, 230, 232, 234, 242 from the propellant supply and is, therefore, ready for the next shot.

Although the present disclosure has been described with reference to particular means, materials and embodiments, from the foregoing description, one skilled in the art can easily ascertain the essential characteristics of the invention and various changes and modifications may be made to adapt the various uses and characteristics without departing from the spirit and scope of the invention.

What is claimed is:

1. A non-lethal pistol comprising:

a body including a grip portion;

a magazine received in the grip portion;

a barrel defining a barrel axis;

a canister of compressed gas received in the body;

a valve assembly configured to selectively vent gas to propel projectiles through the barrel;

a puncture assembly configured to open the canister of compressed gas, wherein the puncture assembly includes a piercing pin configured to move between a first position toward the canister of compressed gas and a second position away from the canister of compressed gas;

a firing mechanism configured to actuate the valve assembly and the puncture assembly;

wherein the firing mechanism includes a cam surface, wherein the cam surface moves the piercing pin toward the canister of compressed gas when the firing mechanism is actuated.

2. The non-lethal pistol of claim 1, wherein the puncture assembly includes a piston with a seal and a biasing member that urges the piston toward the canister of compressed gas.

3. The non-lethal pistol of claim 2, wherein the puncture assembly includes a biasing member that urges the piercing pin away from the canister of compressed gas.

4. The non-lethal pistol of claim 2, wherein the firing mechanism includes a trigger with a cam surface, wherein the cam surface moves the piercing pin toward the canister of compressed gas when the trigger is pulled.

5. The non-lethal pistol of claim 2, wherein the magazine has an internal cavity dimensioned to receive a plurality of projectiles, wherein the magazine includes a closed end and an open end through which projectiles exit the magazine, wherein a follower is in the internal cavity of the magazine and urged toward the open end of the magazine by a biasing member to feed projectiles out of the magazine.

6. The non-lethal pistol of claim 5, further comprising an arm pivotable with respect to the follower for aiding the movement of a last projectile out of the magazine, wherein a longitudinal axis defined by the canister of propellant is substantially in parallel with the barrel axis.

7. The non-lethal pistol of claim 5, wherein the body includes a transverse front face through which projectiles are propelled out of the pistol, wherein the front face includes an opening dimensioned to receive the canister of propellant, wherein the arm includes a projection that is received in a slot in the magazine, wherein the slot is shaped to control rotation of the arm, wherein the slot includes a nonlinear position that rotates the arm due to the projection following the nonlinear portion of the slot.

* * * * *